US006015915A

United States Patent [19]

Jamil et al.

[11] Patent Number: 6,015,915

[45] Date of Patent: Jan. 18, 2000

[54] PROCESS FOR DEGUMMING A FATTY SUBSTANCE AND FATTY SUBSTANCE THUS OBTAINED

[75] Inventors: Said Jamil; Jean-Pierre Ghislain Dufour, both of Brussels; Etienne Marie Joseph Deffense, Mont-sur-Marchienne, all of Belgium

[73] Assignee: Fractionnement Tirtiaux S.A., Fleurus, Belgium

[21] Appl. No.: 08/564,182

[22] PCT Filed: Jun. 16, 1994

[86] PCT No.: PCT/BE94/00041

§ 371 Date: Feb. 26, 1996

§ 102(e) Date: Feb. 26, 1996

[30] Foreign Application Priority Data

Jun. 18, 1993 [BE] Belgium ..... 09300627

[51] Int. Cl.[7] ..... C11B 3/00

[52] U.S. Cl. ..... 554/184; 554/190; 554/204

[58] Field of Search ..... 554/83, 184, 190, 554/204

[56] References Cited

U.S. PATENT DOCUMENTS 4,968,518 11/1990 Lopez .

FOREIGN PATENT DOCUMENTS 0208519 1/1987 European Pat. Off. .
0350379 1/1990 European Pat. Off. .
0387708 9/1990 European Pat. Off. .
0407037 1/1991 European Pat. Off. .
518593 5/1921 France .
1388567 4/1964 France .
1388567 12/1964 France .
687843 2/1953 United Kingdom .

OTHER PUBLICATIONS

English language abstract of Japanese Patent JP62103020.
English language abstract of SU 897841.
English language abstract of SU 1244170.
English language abstract of BR 8703598.
English language abstract of SU 1717621.
English language abstract of JP 62027665.
Chem. abstr., 105:77756, Stenfanov et al, 1986.
Chem. abstr., 101:132926, Diosady et al, 1984.
Chem. abstr., 95:185743, List et al, 1981.
Chem. abstr., 93:24731, 1980.
Chem. Abstr., 92:145287, 1980.
English language abstract of SU 1731793.
English language abstract of EP–350378–A.
WPI/Derwent DW Week 8246—Abstract of SU897841.
"Removal of Non–Hydratable Phosphatides" Research Disclosure, Mar. 1981, No. 203.
WPI/Derwent DW Week 8711—Abstract SU1244170.
WPI/Derwent DW Week 9306—Abstract of SU1717621.
WPI/Derwent DW Week 8711—Abstract 62027665.
Research Disclosure, Mar. 1981, #203.

*Primary Examiner*—Deborah D Carr
*Attorney, Agent, or Firm*—Birch, Stewart, Kolasch & Birch, LLP

[57] ABSTRACT

Process for degumming a fatty substance such as a crude or delecithinated, animal or vegetable oil or fat, including bringing this fatty substance into contact with an aqueous solution of a complexing agent and of a detergent and/or emulsifier making it possible to hydrate the phospholipids present in the latter, and fatty substance thus obtained.

21 Claims, No Drawings

PROCESS FOR DEGUMMING A FATTY SUBSTANCE AND FATTY SUBSTANCE THUS OBTAINED

This application is a 571 of PCT/BE94/0041 filed Jun. 16, 1994.

The present invention relates to a process for degumming a fatty substance such as a crude or delecithinated, animal or vegetable oil or fat, and to the fatty substance thus obtained.

All fatty substances contain a certain number of impurities, liposoluble substances entrained during the bursting of the oil-bearing cells, which can make them unusable for consumption. Some of these impurities have a detrimental influence on the taste, odor and appearance of the product and on its storage.

The purpose of the refining of fatty substances is to remove the free fatty acids, oxidation products, unpleasant flavors, colorants and toxic products (such as pesticides and glycosides), as well as the phospholipids and the metals (such as iron and copper) which are present in trace form and generally bonded to organic compounds.

The presence of phospholipids in the crude oils entails a number of disadvantages. In the presence of water they hydrate and form deposits which decompose in the course of time. Experience also shows that a refined oil which is poorly freed from its phospholipids becomes acidic, oxidizes and rapidly takes on an unpleasant taste. Phospholipids are often bonded to heavy metals (such as calcium, magnesium, iron and copper), some of which have a detrimental influence on the conservation of the refined fatty substances, since they are oxidation catalysts. Phospholipids are also thermally unstable substances which darken the oil when they decompose at high temperature. Finally, since phospholipids are surfactants, their incomplete removal at the beginning of the refining entails the formation of foams and emulsions which result in abnormal losses of oil and deactivation of the decolorizing earths.

Among the fatty substances, some contain few phospholipids (for example palm fat, lauric and animal fats); they can therefore be easily rid of these substances by dry degumming, that is to say by the addition of an acid in order to decompose them and of an earth in order to bind them thereto. Thus, these fatty substances can be refined by neutralizing distillation or physical refining.

The oils obtained by pressing and/or by extraction with the aid of a solvent (for example soya, rape-seed and sunflower oils) are, on the other hand, very rich in phospholipids and are therefore generally refined chemically. Refining of this type presents a number of disadvantages; one of these is that it gives rise to "soapstocks", mixtures of oil and of soaps, which have to be treated, and this involves losses of oil and additional costs.

The total phospholipid content of these crude oils, expressed in the form of phosphorus, can be easily lowered from 800 ppm to 150–200 ppm by aqueous degumming or delecithination. The oil is stirred in the presence of water at 80° C., resulting in hydration and flocculation of the phospholipids. They can therefore be separated by gravity separation or centrifuging. The 150–200 ppm of residual phosphorus represent chiefly the nonhydratable phospholipids, which are complexes of phosphatidic acid and of phosphatidyl ethanolamine, which are combined with divalent ions (such as calcium, iron or magnesium). The removal of these nonhydratable phospholipids, which has become necessary for physical refining, can be carried out by virtue of a special degumming according to various routes:

An acidic degumming which consists in dissociating the phospholipid complex with the aid of an acid in order next to hydrate it. This superdegumming (see German Patents No. 2609705 and 132877), also including a special cooling cycle, produces phosphorus contents which are much lower than with a conventional acidic degumming. However, the final result depends greatly on the quality of the crude oil. Finally, the removal of iron still requires much bleaching earth. This superdegumming has therefore been supplemented (European Patent No. 0 348 004) by a second cooling cycle and the addition of water or of caustic soda to improve the purification. However, this results in a very long, very complex and costly process.

An acidic refining which, by virtue of an acid, dissociates the phospholipid complexes and then converts them in the presence of caustic soda into a completely hydratable sodium complex (see U.S. Pat. No. 4,698,185 and European Patent No. 0 349 178 and European Application No. 92200543.4). This process, requiring intense stirring, makes it possible to obtain oils with a low iron and phospholipid content; however, it requires 2 to 3 separations per centrifuging.

There are also known processes for refining oils and fats by treatment of the fatty substance firstly with an acid of the phosphoric acid type and then with a fatty acid salt or sodium or potassium carboxylate, but these processes involve two stages of treatment of the fatty substance and do not enable a fine emulsion to be obtained.

One of the essential objectives of the present invention consists in overcoming the abovementioned disadvantages of the existing processes and in providing an industrially and economically valid process making it possible to obtain fatty substances such as crude or delecithinated, animal or vegetable oils or fats which are completely degummed in order to permit their physical refining, making it possible especially to remove practically completely the phospholipids which they contain and, more particularly, the nonhydratable phospholipids, when they contain them, and to reduce their iron content.

To this end, the degumming process of the invention consists in mixing the fatty substance to be treated with a reactive aqueous solution of a complexing agent chosen from the group including citric acid, phosphoric acid, oxalic acid, tartaric acid, acids of the aminocarboxylic type, acids of the polyhydroxycarboxylic type, polycarboxylic acids, the salts of these acids and mixtures of two or more of these substances and of an emulsifier of the anionic, cationic, zwitterionic or nonionic type or generated in situ by partial neutralization of the free fatty acids present in the fatty substance, the said solution making it possible of extracted [sic] the phospholipids present in the said fatty substance, the said mixing being carried out by adding, all at once, the aqueous solution of complexing agent and of emulsifier to the fatty substance or vice versa and by subjecting the whole to an intense stirring the rate of which lies between 500 and 15000 revolutions/minute, so as to form a fine emulsion.

According to a particular embodiment of the process of the invention the abovementioned stirring rate lies between 1200 and 10,000 revolutions/minute.

According to a particular embodiment of the process of the invention the abovementioned mixing is done at a temperature of 20 to 100° C., advantageously of 60 to 90° C.

According to a particularly advantageous embodiment of the invention the complexing agent is trisodium citrate or is an acid of the aminocarboxylic type, such as ethylenediaminetetraacetic acid or the disodium or trisodium salt of the latter, and the emulsifier is of the anionic type and consists of sodium lauryl sulfate, of the nonionic type and consists of one or more monoglycerides, or is generated in situ and is sodium and/or potassium carboxylate.

According to another embodiment of the invention the degumming process consists in dispersing the fatty substance in the form of fine droplets in a reactive aqueous solution of a complexing agent chosen from the group including citric acid, phosphoric acid, oxalic acid, tartaric acid, acids of the aminocarboxylic type, acids of the polyhydroxycarboxylic type, polycarboxylic acids, the salts of these acids and mixtures of two or more of these substances and of an emulsifier of the anionic, cationic, zwitterionic or nonionic type or generated in situ by partial neutralization of the free fatty acids present in the fatty substance, the said solution making it possible to extract the phospholipids present in the said fatty substance.

A further subject of the invention is the degummed oils and fats obtained in accordance with the process described above.

Other details and special features of the invention will emerge from the description given below by way of non-limiting example of some embodiments of the invention.

As already stated above, the present invention proposes to degum fatty substances such as crude or delecithinated, animal or vegetable oils or fats, by bringing the fatty substance to be treated into contact with a reactive aqueous solution of a complexing agent and of an emulsifier making it possible to hydrate not only the hydratable phospholipids but above all and in particular the nonhydratable phospholipids if the fatty substance contains them. As already emphasized above, the dissociation and the hydration of the nonhydratable phospholipids, such as phosphatidic acid and phosphatidyl ethanolamine, which are combined with divalent and trivalent metals ($Ca^{++}$, $Mg^{++}$, $Fe^{++}$ or $Fe^{+++}$) is a difficult reaction. On the other hand, the phosphatidic acid and phosphatidyl ethanolamine which are combined with monovalent metals ($Na^{+}$, $K^{+}$) or even an $H^{+}$ cation are easily hydrated and removed from the fatty substance. Until now, complex ionization reactions in the presence of an acid, followed by a shift in equilibrium in the presence of sodium hydroxide enabled this objective to be attained, but nevertheless required a number of separations by centrifuging in order to remove the nonhydratable phospholipids. In accordance with the invention, the oil or the fat to be degummed and the aqueous solution of complexing agent and of emulsifier are mixed by adding, all at once, the aqueous solution to the oil or the fat or vice versa, and by subjecting the whole to an intense stirring the rate of which lies between 500 and 15,000 revolutions/minute and advantageously between 1,200 and 10,000 revolutions/minute, for a period generally of 10 seconds to 5 minutes. The purpose of this intense mixing is, in fact, to disperse the aqueous phase containing the reactants brought into contact (complexing agent and emulsifier) intensely in the oil or the fat so as to form a fine emulsion. The mixing of the fatty substance/aqueous solution of the reactants brought into contact is generally done at a temperature of the order of 20 to 100° C., but a temperature lying between 60 and 90° C. is advantageously employed. A solution of sodium chloride whose concentration varies between 0.1 and 10% may be added to the aqueous phase thus formed and the latter is then separated by gravity separation or centrifuging so as to obtain a degummed fatty substance essentially free from phospholipids. The degummed fatty substance is then either dried and then treated with a bleaching earth or treated directly without drying. The total content of phospholipids, expressed in the form of phosphorus, is much lower than 10 ppm after degumming. Furthermore, an iron content is obtained which is lower than 0.2 ppm, the value required for good conservation of the oil (A. J. Dijkstra, B. Cleenewerk F. S. T. 317–322, 1992). The physical refining of the fatty substance, which is performed after its degumming, therefore now requires only a small quantity of bleaching earth, of the same order as that employed for the chemical refining.

According to the invention, the complexing agents have a much higher affinity constant for the divalent cations than for the monovalent cations; as a result, they displace and preferentially complex the $Ca^{++}$, $Mg^{++}$, $Fe^{++}$ and $Fe^{+++}$ cations. The phosphatidic acid and the phosphatidyl ethanolamine which are thus released are therefore easily hydrated in a sodium form. This reaction of complexing of the divalent or trivalent cations (Mg, Ca, Fe) by the complexing agent requires the preliminary dissociation of the phospholipid-divalent cation complex. This dissociation requires both the presence of a complexing agent chosen from the group including citric acid, phosphoric acid, oxalic acid, tartaric acid, acids of the aminocarboxylic type, acids of the polyhydroxycarboxylic type, polycarboxylic acids, the salts of these acids and mixtures of two or more of these substances and of an emulsifier of the anionic, cationic, zwitterionic or nonionic type or generated in situ by partial neutralization of the free fatty acids present in the fatty substance and, as has just been stated, the use of an intense stirring and of a temperature which is preferably at least 60° C., advantageously from 60 to 90° C. Examples of preferred complexing agents employed within the scope of the present invention are trisodium citrate or acids of the aminocarboxylic type, such as ethylenediaminetetraacetic acid or the disodium and trisodium salts of the latter. The complexing agent will be employed at least in a stoichiometric quantity in relation to the quantity of nonhydratable phospholipids or of total cations (Mg, Ca, Fe) which are present in the fatty substance to be treated. The emulsifier, for its part, is of the anionic, cationic, zwitterionic or nonionic type. The anionic emulsifier, such as sodium lauryl sulfate, is particularly suitable. The emulsifier may also be generated in situ by partial neutralization of the free fatty acids present in the fatty substance. Emulsifiers produced in this way are, for example, sodium and potassium carboxylates. Monoglycerides and their mixtures will be mentioned by way of non-limiting examples of nonionic emulsifiers.

The quantity of water of the aqueous solution-fatty substance mixture may vary between 0.1% and 99% by weight according to the separation conditions employed. As already stated above, the reaction normally takes place between 10 seconds and 5 minutes but can be shortened or last longer if one of the parameters is modified, for example the quantity of water employed, the reaction temperature or the type of reactants brought into contact.

The degumming of soya oils as well as rapeseed, cotton, groundnut, sunflower and corn oils has been successfully carried out by employing the process of the invention. As already mentioned, the process of the invention is particularly suitable for the degumming of fatty substances containing phospholipids consisting essentially of nonhydratable phospholipids, but is also suitable for the degumming of fatty substances which are lean in nonhydratable phospholipids, so as better to remove some gums or mucilages. The degumming is carried out noncontinuously or continuously, followed by a separation by gravity separation or centrifuging. Washing with water after the degumming of the fatty substance is beneficial but absolutely unnecessary.

The fatty substance such as oil may also be dispersed in the form of fine droplets in an aqueous solution containing the chemical reactants. This technique, described in Belgian Patent No. 595,219, employs a column fitted with a jacket and a distribution system into which the fatty substance or the oil is injected continuously in an extremely divided form. An infinite number of oil droplets is thus formed, and these rise slowly countercurrentwise in the aqueous solution. After coalescence at the top of the column, these oil droplets are separated continuously by gravity separation or centrifuging. In general, the reaction may be carried out in a countercurrent extractor or in a pulsed column for liquid/liquid extraction. It is quite obvious that in the case of the use of this technique for dispersion of the fatty substance in the form of fine droplets in the aqueous solution of complexing agent and of emulsifier, the dispersion will also be done at a temperature of between 20 and 100° C. and advantageously between 60 and 90° C. The complexing agents and emulsifiers employed will be the same ones as those illustrated above.

Examples of degumming of fatty material, carried out on the basis of the process in accordance with the invention are given below.

EXAMPLE 1

7 g of delecithinated soya oil whose phospholipid content, expressed in the form of phosphorus, is 80 ppm, and whose acidity, expressed as oleic acid, is 0.32%, are heated to 75° C. in a beaker. 21 ml of an aqueous solution made up of 5-millimolar di- or trisodium ethylenediaminetetraacetate salt and of 1.7-millimolar sodium lauryl sulfate are also heated to 75° C. The aqueous solution is added all at once to the oil. The mixture is stirred intensely for 45 seconds with the aid of an Ultra-Turax (type 725=Janke & Kunkel KG) at 9,500 revolutions/minute.

The emulsion thus obtained is broken by adding 10 ml of a saturated sodium chloride solution or centrifuged directly at 5,000 revolutions/minute.

The phosphorus content, determined by the method of calorimetric [sic] determination of phosphorus (AOCS ca 12–55), is 6 ppm. The cation content, determined by atomic absorption according to the IUPAC method 2,631, is given in ppm.

| CATION | BEFORE TREATMENT | AFTER TREATMENT |
|---|---|---|
| Magnesium | 18 | 0.2 |
| Calcium | 46 | 1 |
| Iron | 0.55 | 0.04 |

By treating 7 g of delecithinated rapeseed oil in the same way as above, a phosphorus content of 5 ppm is obtained, determined by the same method of determination.

EXAMPLE 2

300 g of delecithinated soya oil are heated to 75° C. in a beaker. 900 ml of an aqueous solution made up of 5-millimolar di- or trisodium ethylenediaminetetraacetate salt and of 1.7-millimolar sodium lauryl sulfate are also heated to 75° C. The aqueous solution is added all at once to the oil. The mixture is stirred intensely for 45 seconds with the aid of an Ultra-Turax (type T45=Janke & Kunkel KG) at 10,000 revolutions/minute.

The emulsion thus obtained is broken by adding 400 ml of a saturated sodium chloride solution or centrifuged directly at 5,000 revolutions/minute.

The phosphorus content, determined by the method of calorimetric determination of phosphorus (AOCS ca 12–55), is 6 ppm. The cation content, determined by atomic absorption according to IUPAC method 2,631, is given in ppm.

The results below are given for two different soya oils.

| | BEFORE TREATMENT | AFTER TREATMENT |
|---|---|---|
| SOYA OIL No. 1 | | |
| Phosphorus (ppm) | 73 | 5.5 |
| Acidity (oleic acid) % | 0.32 | |
| Calcium | 46 | 1 |
| Magnesium | 16 | <0.2 |
| Iron | 0.55 | 0.04 |
| SOYA OIL No. 2 | | |
| Phosphorus (ppm) | 122 | 6.5 |
| Acidity (oleic acid) % | 4.24 | |
| Calcium | 68 | 1 |
| Magnesium | 36 | <0.2 |
| Iron | 4.9 | 0.05 |

EXAMPLE 3

300 g of delecithinated soya oil whose phospholipid content, expressed in the form of phosphorus, is 80 ppm and whose acidity, expressed as oleic acid, is 0.32%, are heated to 75° C. in a beaker. 900 ml of an aqueous solution made up of 10-millimolar trisodium citrate and 1.7-millimolar sodium lauryl sulfate are also heated to 75° C. The aqueous solution is added all at once to the oil. The mixture is stirred intensely for 45 seconds with the aid of an Ultra-Turax (type T 45=Janke & Kunkel KG) at 10,000 revolutions/minute.

The emulsion thus obtained is broken by adding 10 ml of a saturated sodium chloride solution or centrifuged directly at 5,000 revolutions/minute.

The phosphorus content, determined by the method of calorimetric determination of phosphorus (AOCS ca 12–55), and the cation content, determined by atomic absorption according to the IUPAC method 2,631, is given below.

| | BEFORE TREATMENT | AFTER TREATMENT |
|---|---|---|
| Phosphorus | 80 | 2.2 |
| Iron | 0.55 | 0.03 |

EXAMPLE 4

According to the conditions described in Example 1, the test was performed in the presence of various emulsifiers the concentration of which, which is 1.7-millimolar, remains constant.

The Table below gives the phosphorus content after treatment with two different soya oils.

| | SOYA OIL No. 1 | SOYA OIL No. 2 |
|---|---|---|
| Acidity % (oleic ac.) % | 0.32 | 4.24 |
| Phosphorus ppm | 73 | 122 |

| EMULSIFIERS | RESIDUAL PROSPHORUS AFTER TREATMENT | RESIDUAL PHOSPHORUS AFTER TREATMENT |
|---|---|---|
| ANIONIC | | |
| Dioctyl sulfosuccinate | 5.2 | 7.1 |
| Na lauryl sulfate | 6.1 | 7.3 |
| CATIONIC | | |
| Cetylpyridinium | 4.0 | 6.3 |
| Dodecyltrimethyl-ammonium | 5.5 | 5.2 |
| Hexadecyltrimethyl-ammonium | 4.5 | 7.4 |
| Tetradecyltrimethyl-ammonium | 4.9 | 5.1 |
| ZWITTERIONIC | | |
| Lauryl sulfobetaine | 4.7 | 7.3 |
| Tetramethylsulfobetaine | 5.8 | 6.6 |
| NONIONIC | | |
| Triton X100 | 3.1 | 3.3 |
| Triton X114 | 2.3 | 3.1 |
| Tween 20 | 3.5 | 3.4 |

We claim:

1. A process for degumming a fatty substance, comprising the steps of:

mixing said fatty substance with a reactive aqueous solution of a complexing agent consisting of ethylenediaminetetracetic acid or a salt thereof and optionally one member selected from the group consisting of citric acid, phosphoric acid, oxalic acid, tartaric acid, acids of the aminocarboxylic type, acids of the polyhydroxycarboxylic type, polycarboxylic acids, the salts of these acids and mixtures of two or more of these substances and an anionic, cationic, zwitterionic or nonionic type emulsifier or an emulsifier that is generated in situ by partial neutralization of free fatty acids present in the fatty substance, to extract phospholipids present in said fatty substance, said mixing being carried out by adding, all at once, the aqueous solution of complexing agent and emulsifier to the fatty substance or vice versa; and stirring the mixture at a rate between 500 and 15000 revolutions/minute to form a fine emulsion, wherein after degumming, said fatty substance has a total content of phospholipids, expressed in the form of phosphorus, of less than 10 ppm.

2. The process in accordance with claim 1, wherein the rate of stirring is 1,200 to 10,000 revolutions/minute.

3. The process in accordance with claim 1, wherein the mixing is done at a temperature of 20 to 100°C.

4. The process in accordance with claim 3, wherein the temperature employed lies between 60 and 90°C.

5. The process in accordance with claim 1, further comprising the step of separating the aqueous phase thus formed after mixing to obtain a degummed fatty substance essentially free from phospholipids.

6. The process in accordance with claim 1, further comprising the step of physically refining the fatty substance after mixing.

7. The process in accordance with claim 1, wherein the phospholipids that the fatty substance contains are essentially nonhydratable phospholipids.

8. The process in accordance with claim 1, wherein the complexing agent is employed at least in a stoichiometric quantity relative to the quantity of nonhydratable phospholipids present in the fatty substance.

9. The process in accordance with claim 1, wherein the emulsifier is anionic and comprises sodium lauryl sulfate.

10. The process in accordance with claim 1, wherein the emulsifier is generated in situ and is sodium and/or potassium carboxylate.

11. The process in accordance with claim 1, wherein the emulsifier is nonionic and comprises one or more monoglycerides.

12. A fatty substance obtained by the process in accordance with claim 1.

13. A process for degumming a fatty substance, comprising the step of dispersing the fatty substance in the form of fine droplets in a reactive aqueous solution of a complexing agent consisting of ethylenediaminetetracetic acid or a salt thereof and optionally one member selected from the group consisting of citric acid, phosphoric acid, oxalic acid, tartaric acid, acids of the aminocarboxylic type, acids of the polyhydroxycarboxylic type, polycarboxylic acids, the salts of these acids and mixtures of two or more of these substances and an anionic, cationic, zwitterionic or nonionic type emulsifier or an emulsifier that is generated in situ by partial neutralization of free fatty acids present in the fatty substance, to extract phospholipids present in said fatty substance, wherein after degumming, said fatty substance has a total content of phospholipids, expressed in the form of phosphorus, of less than 10 ppm.

14. The process in accordance with claim 13, wherein the dispersion is done at a temperature of 20 to 100° C.

15. The process in accordance with claim 14, wherein the temperature employed lies between 60 and 90° C.

16. The process in accordance with claim 13, wherein the phospholipids that the fatty substance contains are essentially nonhydratable phospholipids.

17. The process in accordance with claim 13, wherein the complexing agent is employed at least in a stoichiometric quantity relative to the quantity of nonhydratable phospholipids present in the fatty substance.

18. The process in accordance with claim 13, wherein the emulsifier is anionic and comprises sodium lauryl sulfate.

19. The process in accordance with claim 13, wherein the emulsifier is generated in situ and is sodium and/or potassium carboxylate.

20. The process in accordance with claim 13, wherein the emulsifier is nonionic and comprises one or more monoglycerides.

21. A fatty substance obtained by the process in accordance with claim 13.

* * * * *